US007389989B1

(12) United States Patent
Hong

(10) Patent No.: US 7,389,989 B1
(45) Date of Patent: Jun. 24, 2008

(54) CASINO CARD GAME HAVING MAHJONG ATTRIBUTES

(76) Inventor: Hwei-Wen Wayne Hong, 2208 Encinal Ave., Alameda, CA (US) 94501

( * ) Notice: Subject to any disclaimer, the term of this patent is extended or adjusted under 35 U.S.C. 154(b) by 148 days.

(21) Appl. No.: 11/531,244

(22) Filed: Sep. 12, 2006

(51) Int. Cl.
*A63F 1/00* (2006.01)

(52) U.S. Cl. ..... 273/274; 273/292

(58) Field of Classification Search ..... 273/274, 273/309, 292; 463/11–13
See application file for complete search history.

(56) References Cited

U.S. PATENT DOCUMENTS 5,522,595 A * 6/1996 Wong ..... 273/292
6,336,858 B1 * 1/2002 Yoseloff ..... 463/13
6,688,598 B1 * 2/2004 Hsi ..... 273/292
6,834,857 B2 * 12/2004 Lee et al. ..... 273/292

OTHER PUBLICATIONS

Asian Games:The Art of Contest, Asia Society, pp. 216-222, 2004.*

* cited by examiner

*Primary Examiner*—William M Pierce
(74) *Attorney, Agent, or Firm*—Rob L. Phillips; Grennberg Traurig

(57) ABSTRACT

A method of conducting a Mahjong-style card game is disclosed. The method comprises utilizing a deck of cards depicting Mahjong-type symbols. In one version, players place a Tian-Hu wager, and optionally a bonus wager, and receive six cards. Players then have the option to progress through four rounds of play, including additional wagers and folding options, wherein players seek to form a Hu in the form of a Tian-Hu, Di-Hu, Fa-Hu or Ting-Hu using cards in their individual hand and/or in combination with community cards. A Hu comprises a pair of cards having a same suit and rank in combination with a three-card run or trips. Optional double down and bonus wagers may also be offered to players.

25 Claims, 13 Drawing Sheets

| | |
|---|---|
| Tian-Hu: | 5 to 1 |
| Di-Hu: | 2 to 1 |
| Fa-Hu (8-Hu): | 1 to 1 |
| Ting-Hu (10-Hu): | 1 to 1 |
| Flush-Hu: | 1/2 x Last Bet |

150

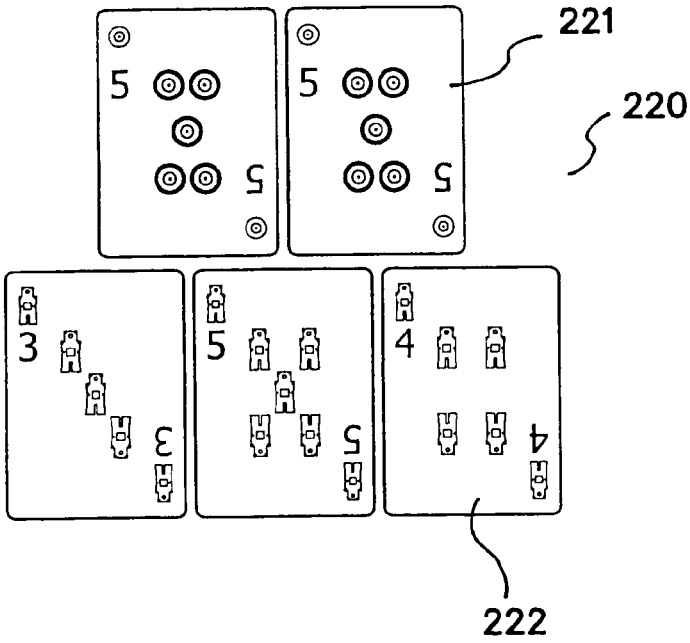
FIG. 8
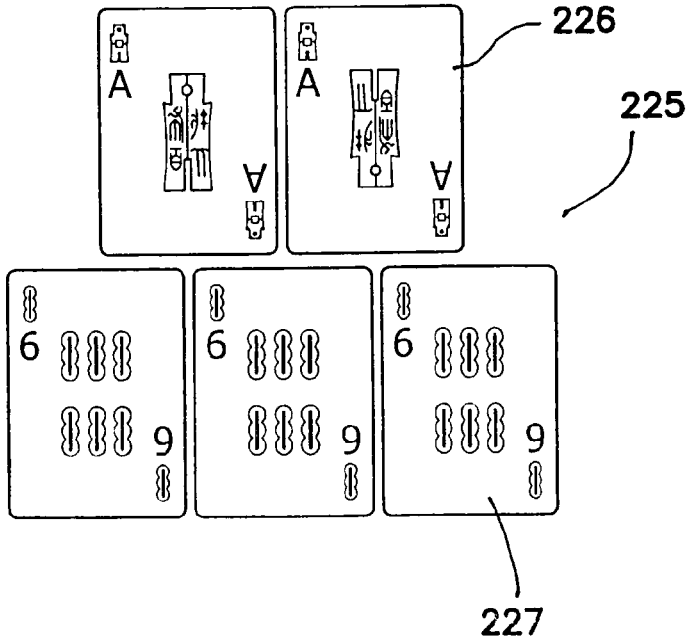

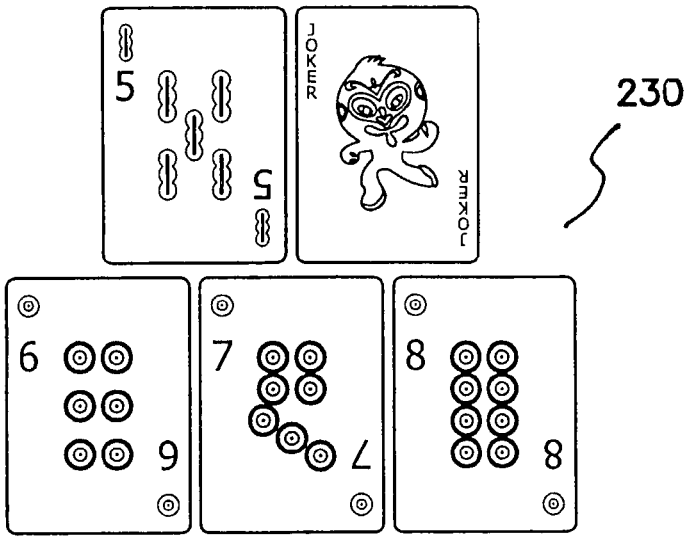
FIG. 9
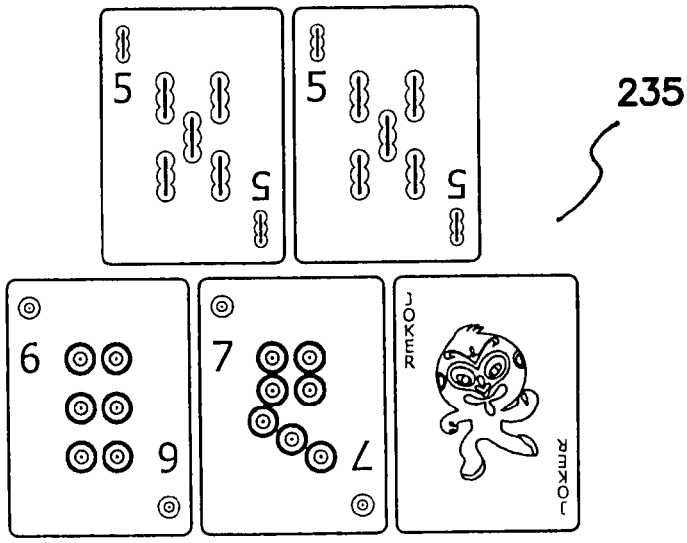

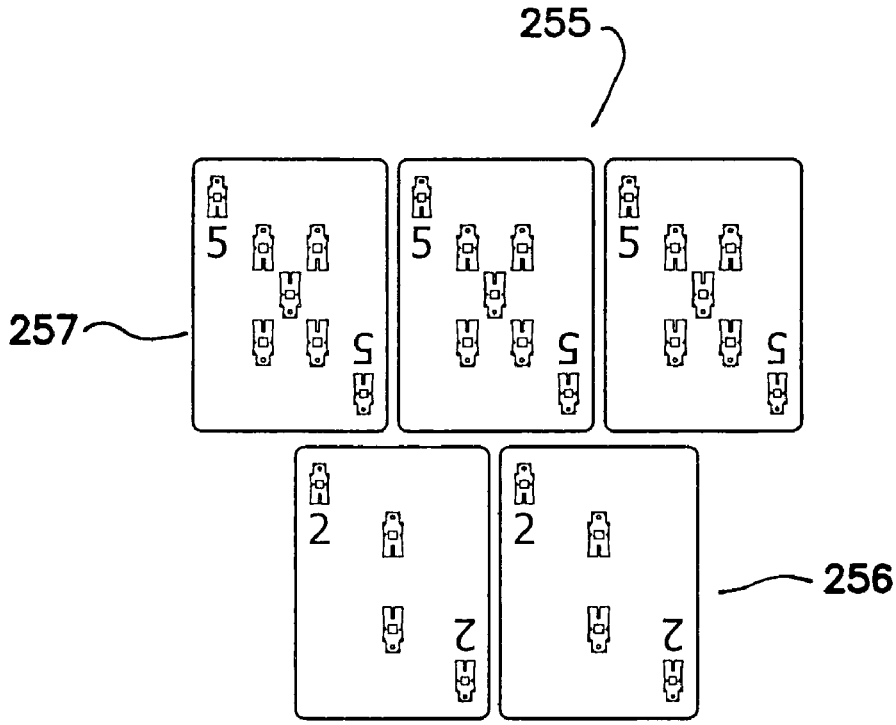
FIG. 12
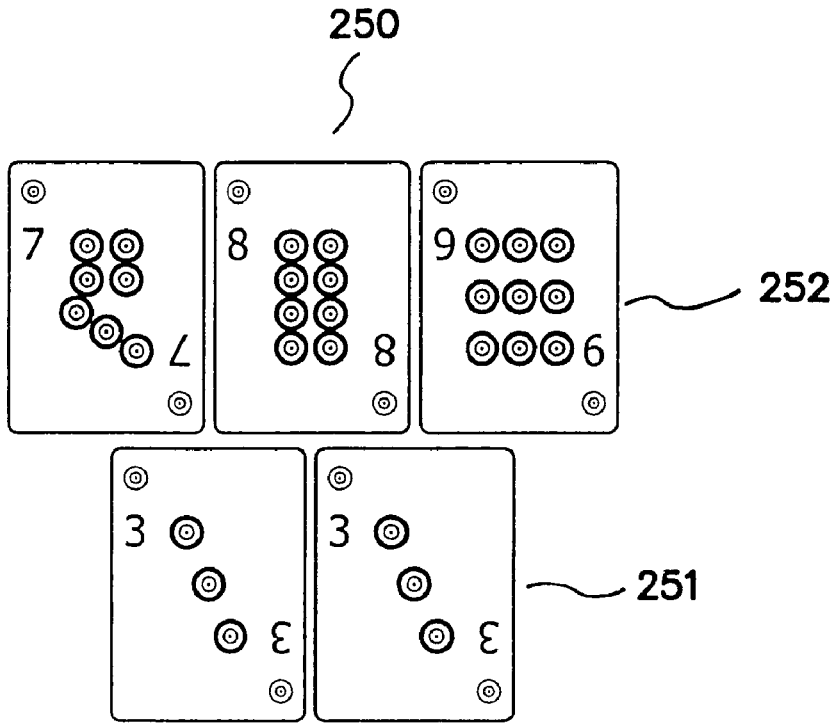

500

| HAND | PAYOUTS |
|---|---|
| TIAN HU (NO FLUSH) | 5 x TIAN HU WAGER |
| TIAN HU FORMING A FLUSH | 5.5 x TIAN HU WAGER |
| DI HU (NO FLUSH) | 2 x TIAN HU WAGER (4 x TIAN HU WAGER IF DI HU DOUBLE DOWN WAGER PLACED) |
| DI HU FORMING A FLUSH | 2.5 x TIAN HU WAGER (5 x TIAN HU WAGER IF DI HU DOUBLE DOWN WAGER PLACED) |
| FA HU (NO FLUSH) | TIAN HU WAGER + FA HU WAGER (i.e., EVEN MONEY ON BOTH WAGERS) |
| FA HU FORMING A FLUSH | TIAN HU WAGER + 1.5 x FA HU WAGER |
| TING HU (NO FLUSH) | TIAN HU WAGER + FA HU WAGER + TING HU WAGER (i.e., EVEN MONEY ON ALL THREE WAGERS) |
| TING HU FORMING A FLUSH | TIAN HU WAGER + FA HU WAGER + 1.5 x TING HU WAGER |

FIG. 14

CASINO CARD GAME HAVING MAHJONG ATTRIBUTES

FIELD OF THE INVENTION

The embodiments of the present invention relate to a casino card game. More particularly, the embodiments of the present invention constitute a new casino card game based on the Chinese game of Mahjong.

BACKGROUND

Mahjong is a Chinese game played by four players against one another. It is a game of skill, strategy, intelligence, calculation and luck. Depending on the variation which is played, luck can be anything from a minor to a dominant factor in success. The object of the game is to build complete suits (usually of threes) from thirteen to sixteen tiles. The first person to achieve this goal is said to win the game. The game is very popular in Asia but has not attained the same level of popularity on other continents. One reason is the level of sophistication and complexity of the game. Another reason is the use of unfamiliar tiles which are not as well known as other gaming props like playing cards or dice.

It would be advantageous to conduct a casino Mahjong game using cards to attract new players and to attract experienced Mahjong players visiting casinos and other gaming establishments.

SUMMARY

Accordingly, a first embodiment of the present invention is a method of conducting a card game comprising: requiring participating players to place an initial wager to participate in a current hand; providing one or more participating players with at least five initial cards; providing payouts to any player optionally declaring a Tian-Hu formed using the at least five initial cards wherein any such player is out of the current hand; allowing remaining players to place an additional Di-Hu double-down wager; requiring remaining players to discard at least one card and providing each player with a number of replacement cards equal to the number of discards; providing payouts to any player optionally declaring a Di-Hu formed using the at least five cards, comprising the held initial cards and the replacement cards, wherein any such player is out of the current hand; requiring remaining players to place a second wager and to discard at least one card in order to continue in the hand or allowing players to fold thereby losing the initial wager; revealing a first set of one or more community cards; providing payouts to any player holding a Fa-Hu formed using the at least five cards, comprising a combination of some initial cards and the replacement cards, in combination with the first set of one or more community cards, wherein any such player is out of the current hand; requiring remaining players to place a third wager in order to continue in the hand or allowing players to fold thereby losing the initial and second wagers; revealing a second set of one or more community cards; and providing payouts to any player holding a Ting-Hu formed using the at least five cards, comprising the held initial cards and the replacement cards, in combination with the first and second sets of one or more community cards wherein at least one card of a Ting-Hu hand must be a held initial card or replacement card.

The card game utilizes Mahjong principles in the form of a casino card game pitting players against the house. Cards are more typical for casino games and will be more apt to attract players than atypical tiles. Moreover, the cards depict only a small set of Mahjong suits to maintain the ease of play of the game. The cards are similar to poker cards in size and design, enabling the use of automatic card shufflers and other relevant gaming devices and equipment with little or no modification.

The embodiments of the present invention may be implemented live or online. The embodiments may also be facilitated by electronic gaming devices or a global computer network (e.g., the Internet).

Other variations, embodiments and features of the present invention will become evident from the following detailed description, drawings and claims.

BRIEF DESCRIPTION OF THE DRAWINGS

FIG. 8 illustrates two exemplary hands, each forming a Hu;

FIG. 9 illustrates two exemplary hands, each forming a Hu with a joker;

FIG. 12 illustrates an exemplary hand constituting a flush Hu;

FIG. 14 illustrates an exemplary payout scheme for each stage of one embodiment of the present invention.

DETAILED DESCRIPTION

Figure 1:
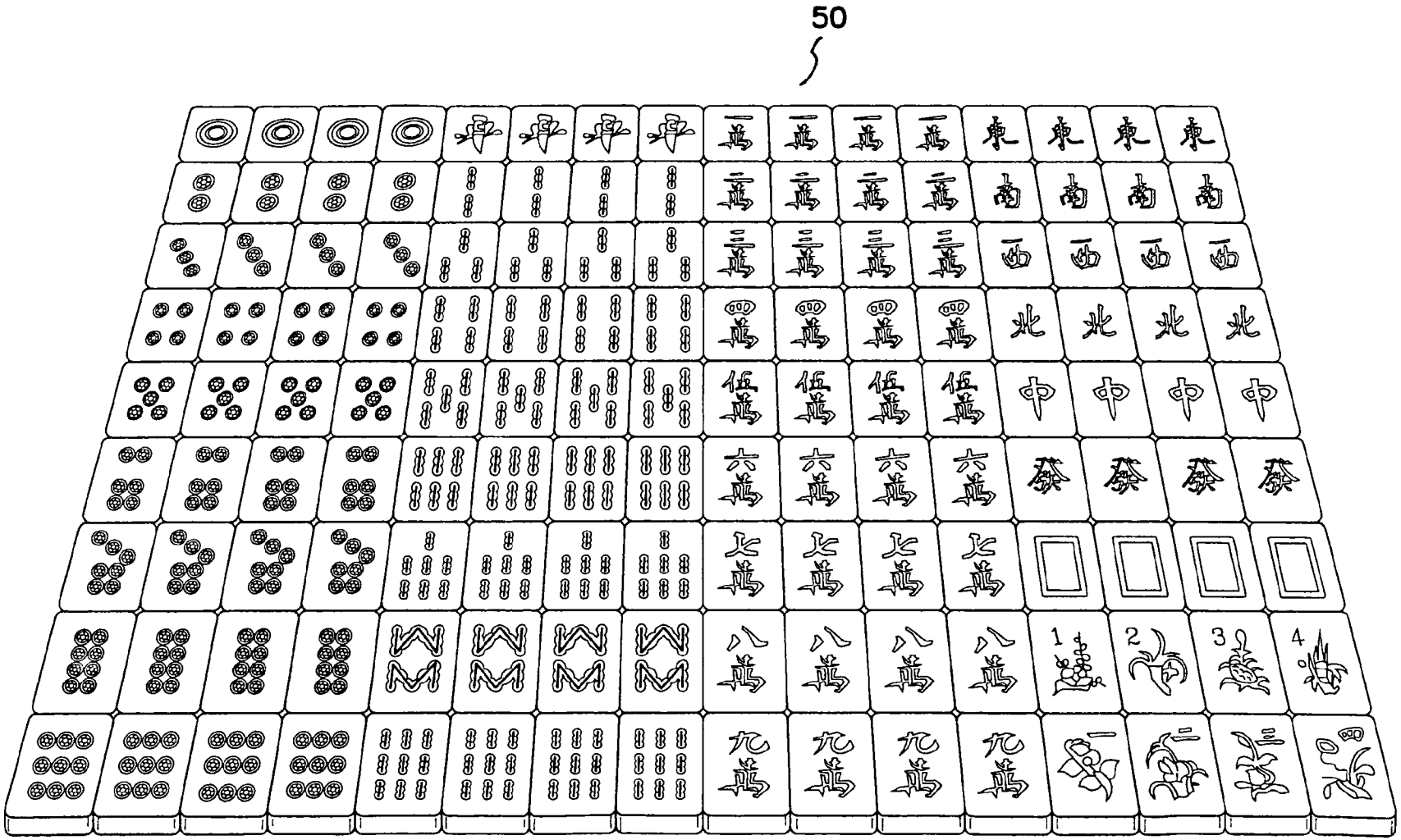
FIG. 1 illustrates conventional Mahjong tiles.

For the purpose of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Figure 2:
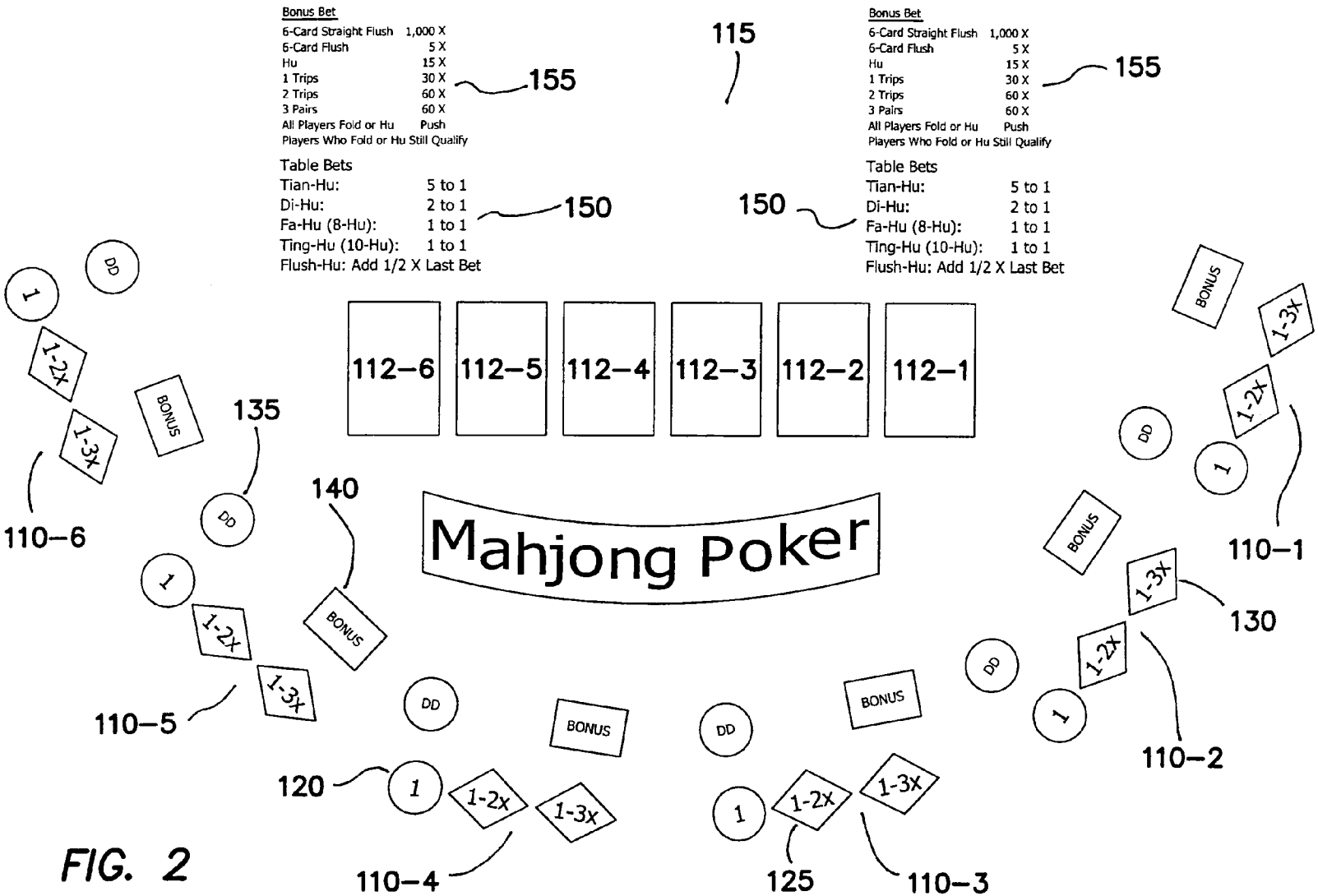
FIG. 2 illustrates an exemplary gaming table layout for facilitating the embodiments of the present invention.
Figure 3:
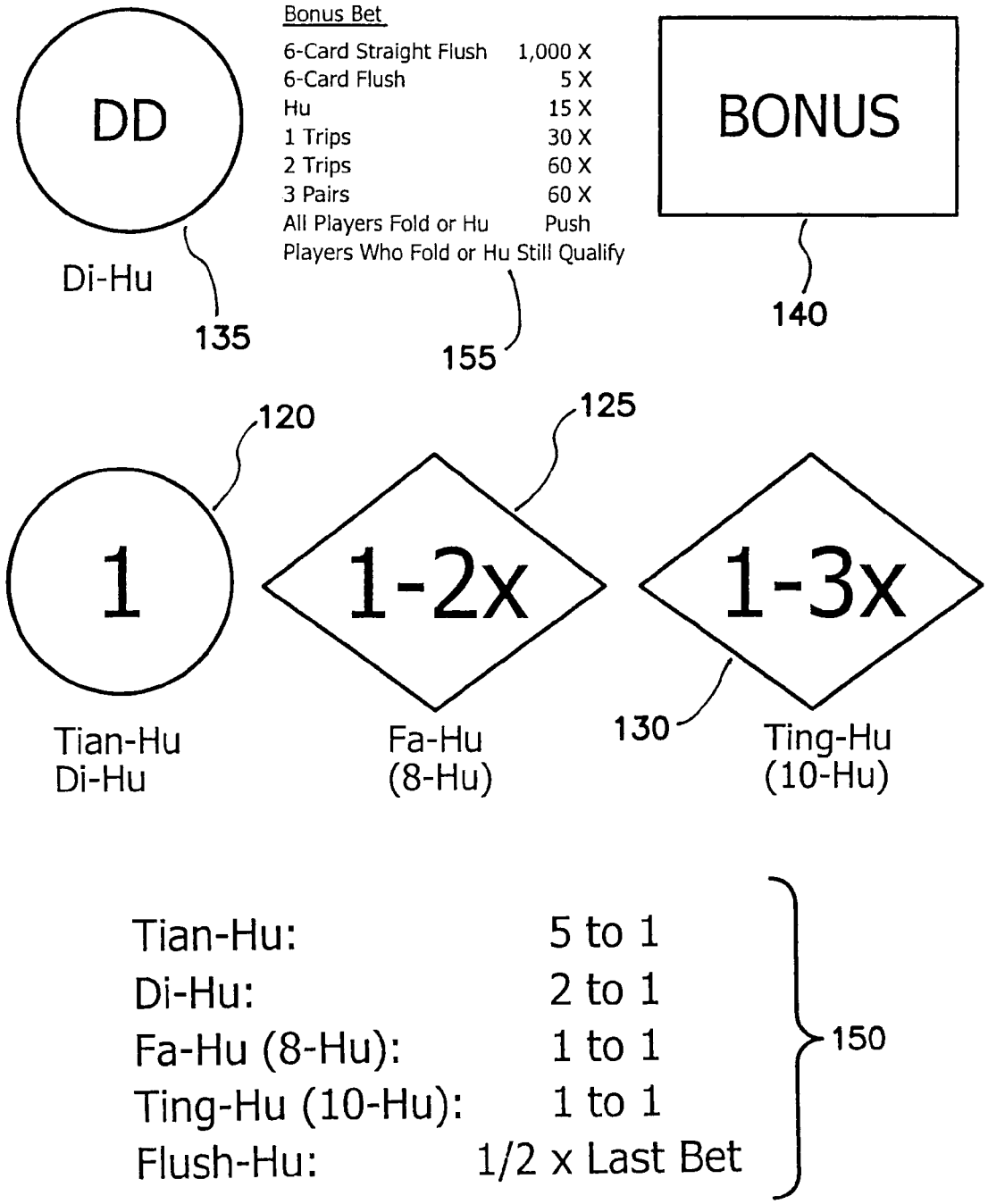
FIG. 3 illustrates one player position of the gaming table layout illustrated in FIG. 2.
Figure 4:
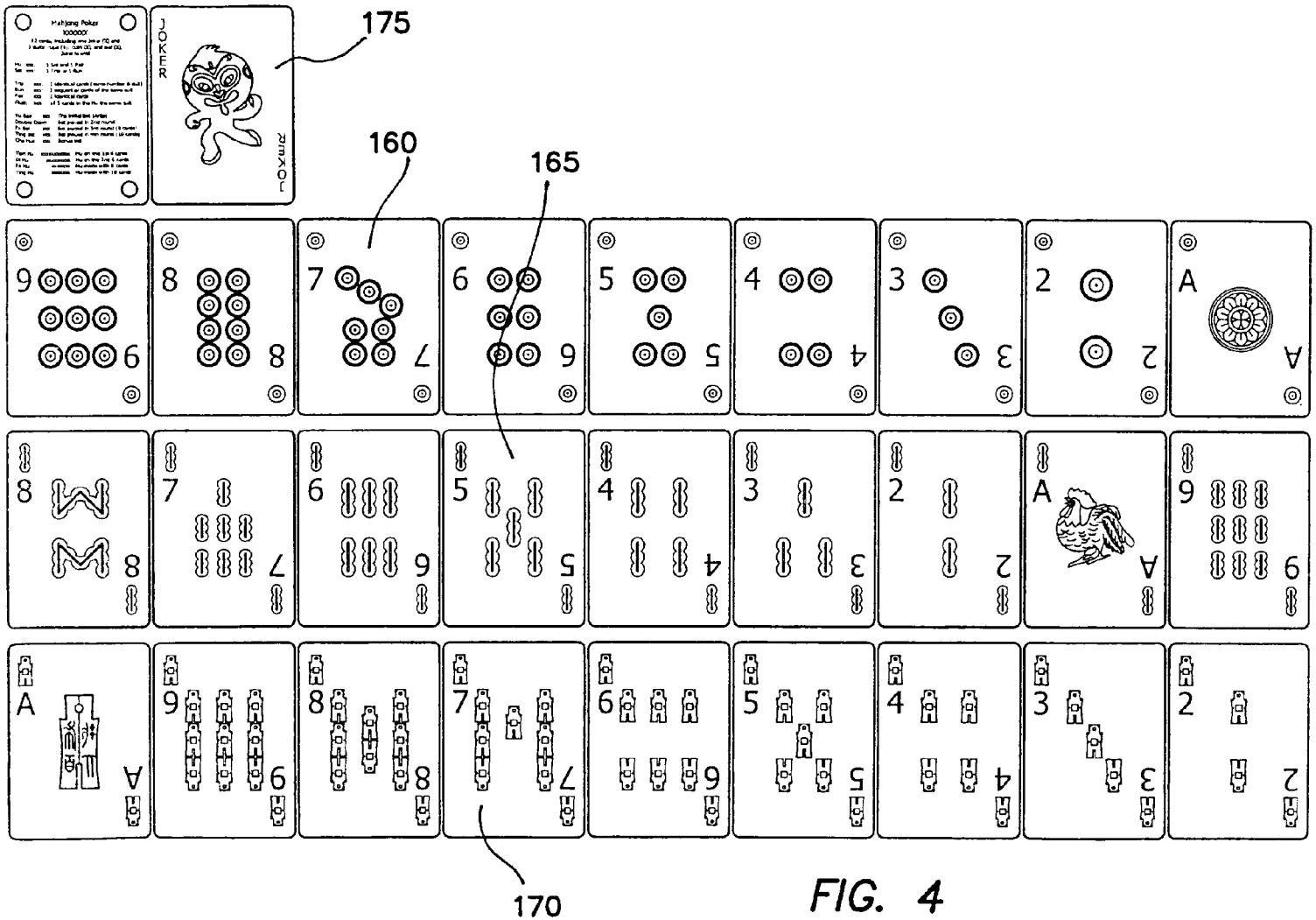
FIG. 4 illustrates four cards depicting a copper suit, bamboo suit, kanji suit and a joker.

Reference is now made to the figures wherein like parts are referred to by like numerals throughout. FIG. 1 shows exemplary Mahjong tiles 50 used to play conventional Chinese Mahjong. FIG. 2 shows a gaming table layout generally referenced by numeral 100. As shown, the table layout 100 accommodates six player positions 110-1 through 110-6 and a dealer position 115 and may be played at a blackjack style table, online or via electronic gaming devices. The game may be modified slightly to accommodate seven players as well. Six replacement card areas 112-1 through 112-6 are depicted adjacent to the dealer position 115. As shown in FIGS. 2 and 3, each player position 110-1 through 110-6 depicts five wager areas comprising a Tian-Hu, Di-Hu wager area 120, Fa-Hu (8-Hu) wager area 125, Ting-Hu (10-Hu) wager area 130, Di-Hu double down wager area 135 and bonus wager area 140. The meaning and significance of each wager area 120 through 140 is described in detail below. A game pay table 150 and bonus pay table 155 may also be depicted adjacent to each player position 110-1 through 110-6 or single pay tables 150, 155 may be prominently depicted on the table layout 100. The table over which the table layout 100 is positioned may also support a chip rack, tip box, dead card container, card shoe and/or card shuffling device. The wager areas 120 through 140 support a Mahjong card game using 82 cards. As shown in FIG. 4, the cards comprise 3 suits termed the "copper" 160, "bamboo" 165 and "kanji" 170. It is recognized by those skilled in the art that the suits and/or terms associated therewith may take any form (for example, tong, tiao and wan, or coin, rope and wan). The deck comprises three identical cards numbered 1 through 9 within each suit so that each suit makes up 27 cards. The $82^{nd}$ card is a joker 175 that is wild and may represent any card (rank and suit) in the deck.

Figure 5:
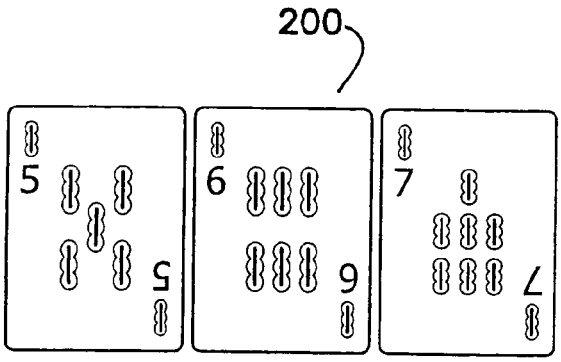
FIG. 5 illustrates an exemplary hand forming a run (also known as a straight)
Figure 6:
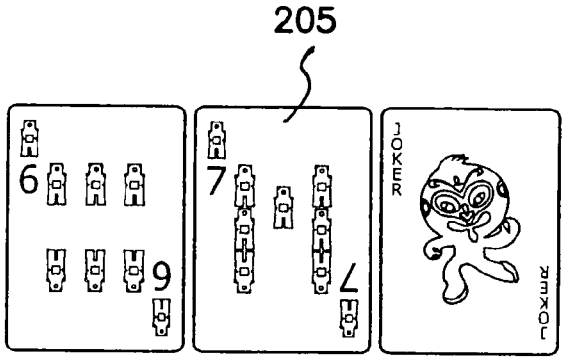
FIG. 6 illustrates an exemplary hand forming a run with a joker.
Figure 7:
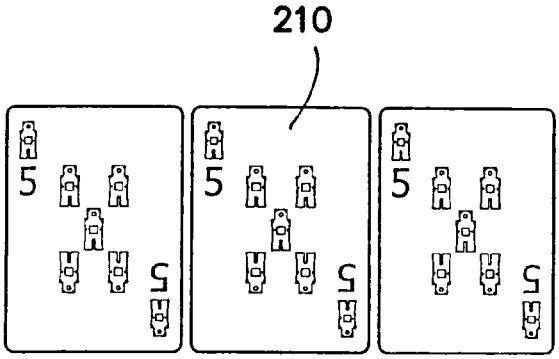
FIG. 7 illustrates an exemplary hand forming trips.
Figure 10:
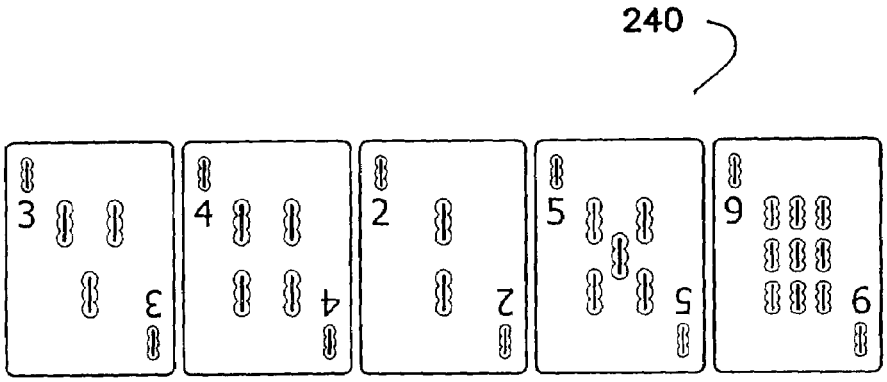
FIG. 10 illustrates an exemplary hand forming a flush.
Figure 11:
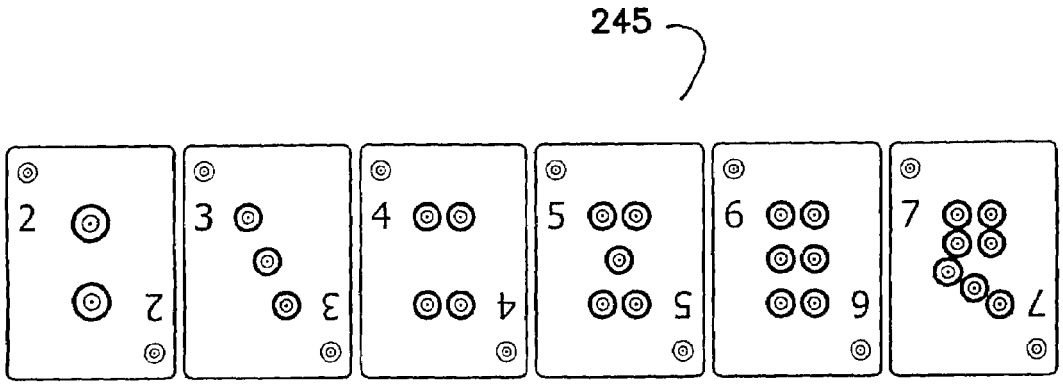
FIG. 11 illustrates an exemplary hand forming a straight flush.

FIGS. 5-12 show different Mahjong hands according to the embodiments of the present invention. FIG. 5 shows a hand 200 forming a three-card run of cards having sequential ranks and the same suit. FIG. 6 shows a hand 205 forming a three-card run with the use of a joker. In this instance, the joker acts as the third card (i.e., 8 of kanji) thereby creating a three-card run. FIG. 7 shows a hand 210 forming trips. Trips comprises three cards of the same numerical rank and suit. FIG. 8 shows two five-card hands 220, 225 forming Hus. A Hu can be formed in two distinct manners. A first Hu 220 is a hand comprising a pair of suited cards 221 in combination with a three-card run 222. A second Hu 225 is a hand comprising a pair of suited cards 226 in combination with trips 227. FIG. 9 shows two five-card hands 230, 235 forming Hus. Hand 230 utilizes a joker to complete the pair of suited 5s while hand 235 utilizes the joker to complete the three-card run comprising the 6, 7 and 8 of copper. FIG. 10 shows a six-card hand 240 forming a flush. A flush comprises a collection of cards having the same suit. FIG. 11 shows a six-card hand 245 forming a straight flush comprising six cards of the same suit and in sequence. FIG. 12 shows two five-card hands 250, 255 forming flush Hus. A flush Hu can be formed in two distinct manners. A first flush Hu 250 is a hand comprising a pair of suited cards 251 in combination with a three-card run 252 wherein each of the five cards is of the same suit. A second flush Hu 255 is a hand comprising a pair of suited cards 256 in combination with trips 257 wherein each of the cards is of the same suit.

Figure 13A:
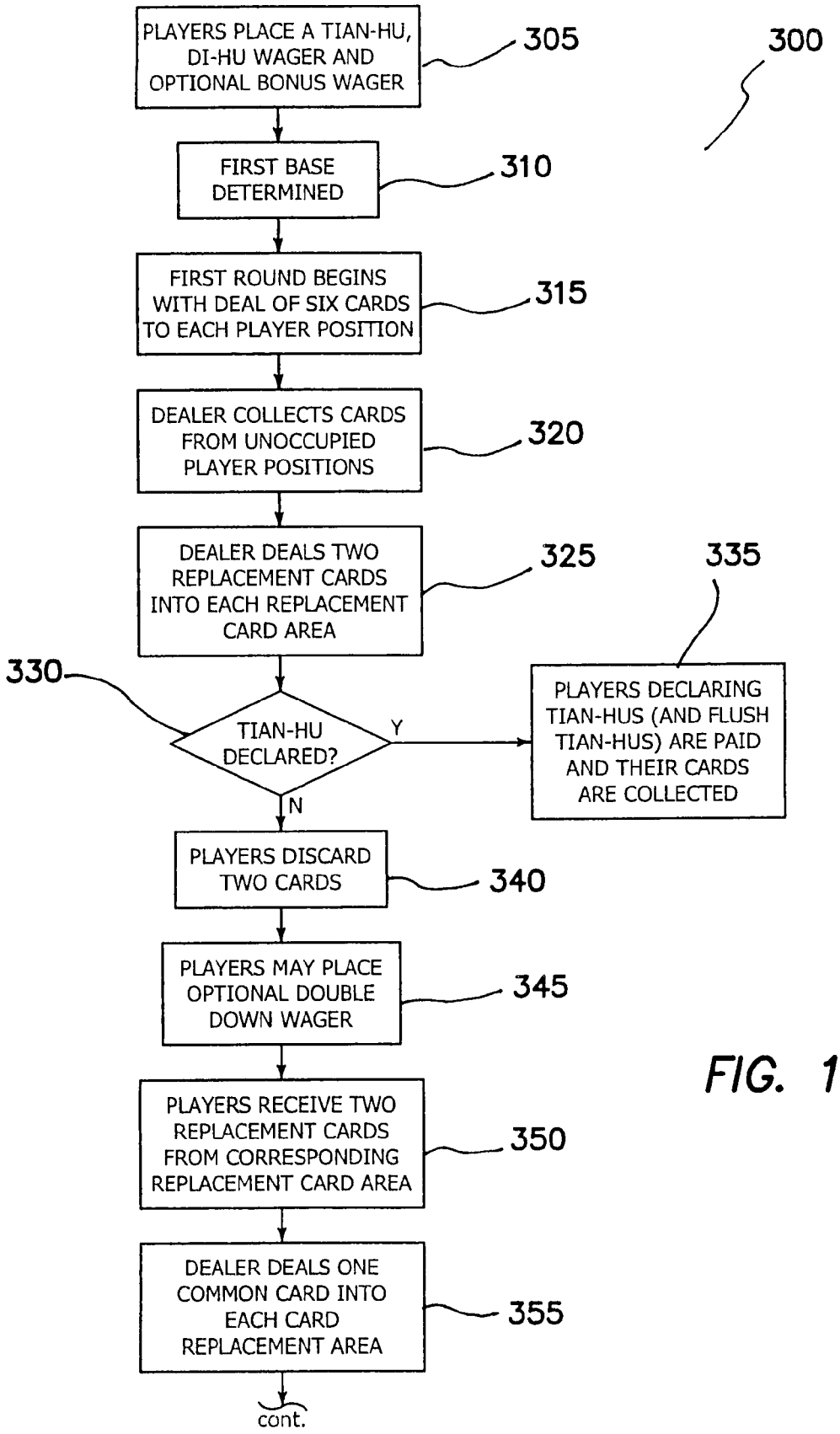
FIGS. 13*a*-13*c* illustrate a flow chart detailing one embodiment of the present invention.
Figure 13B:
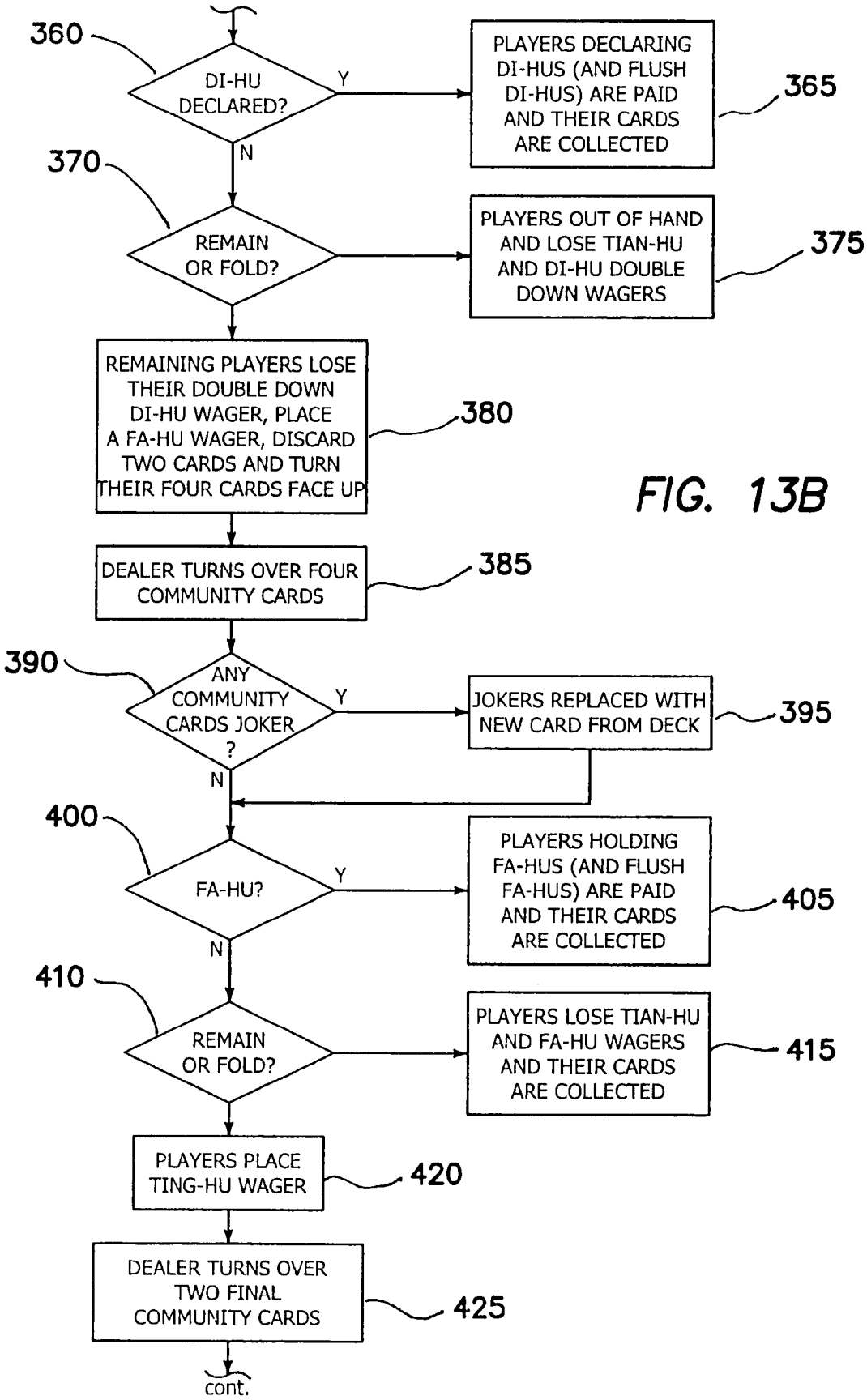
Figure 13C:
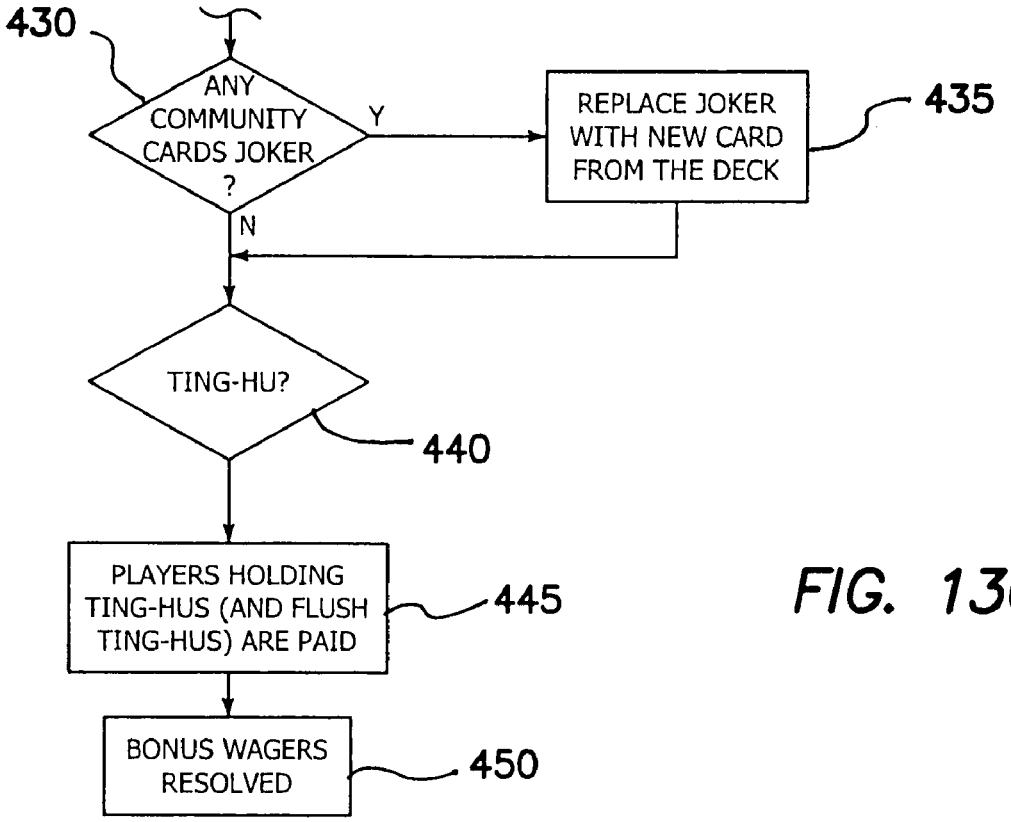

FIGS. 13*a*-13*c* show a flow chart 300 detailing one embodiment of the present invention. At 305, players place a Tian-Hu, Di-Hu wager (deemed a Ya Bao) into the Tian-Hu, Di-Hu wager area 120 and may optionally place a bonus wager (deemed a Cha Hua) into the bonus wager area 140. Casinos are responsible for setting the initial minimum and maximum wagering limits on all table wagers. Consequently, different tables may have different limits such that some table limits are designed to attract novice players while other table limits are designed to attract high rollers. At 310, a single dice is thrown by the dealer to determine which player is deemed "first base" thus receiving his or her cards first for this hand. The six player positions 110-1 through 110-6 each correspond to a different side of the six-sided dice such that a rolled 1 corresponds to player position 110-1 and so on. Based on the roll outcome, a first base marker is placed at the player position 110-1 through 110-6 regardless of whether a player is seated in the player position 110-1 though 110-6 or not. It should be noted that other means, including playing cards, may be used to determine first base or first base can be rotated between player positions 110-1 through 110-6 after each hand. At 315, a first round begins with the dealer dealing six face-down cards, starting at first base and proceeding in a clockwise manner, to each player position 110-1 through 110-6. The cards are dealt whether the player position 110-1 through 110-6 is occupied by a player or not. At 320, the dealer collects any cards dealt to unoccupied player positions 110-1 through 110-6. While players are inspecting their six cards, at 325, the dealer deals two, face-down replacement cards into each replacement card area 112-1 through 112-6. At 330, players holding cards forming a Hu may declare the Hu or may elect not to declare the same. At 335, if any player declares a Hu (deemed a Tian-Hu at this stage of the hand), the player reveals his or her cards and is paid, according to pay table 150, 5 to 1 on his or her Tian-Hu wager and, if the initial cards also form a five-card flush, the flush Hu bonus of one-half the Tian-Hu wager. Any declaring player turns in his or her cards and is out of the remainder of the hand, except that the player's bonus wager, if any, remains in play. Any player not declaring a Hu remains in the hand. A player may elect not to declare a Tian-Hu in an effort to maximize the return on the hand. By not electing to declare a Tian-Hu, a player remains in the hand and may, as described below, may obtain a Di-Hu and/or Flush Di-Hu with a double down wager in place, a Fa-Hu (also deemed an 8-Hu since there are 8 cards available to make the Hu) and/or flush Fa-Hu with additional wagers in place or a Ting-Hu (also deemed a 10-Hu since there are 10 cards available to make the Hu) and/or flush Ting-Hu with additional wagers in place.

At 340, each player that did not declare a Hu after the initial cards must discard two of his or her initial six cards. At 345, each remaining player has the option to place a wager in the Di-Hu double down wager area 135. In one embodiment, the Di-Hu double down wager must equal the player's Tian-Hu wager. The Di-Hu double down wager is only active for this second round of the game. At 350, each player is provided with two replacement cards from the cards previously dealt into the replacement areas 112-1 through 112-6. Replacement card area 112-1 is dedicated to the player, if any, designated as first base, while cards in the replacement area 112-2 are dedicated to the player, if any, seated immediately clockwise from the first base position and so on. Thus, if no player is seated at a player position 110-1 through 110-6 corresponding to the replacement card area 112-1 through 112-6, the replacement cards in those areas are collected as dead cards by the dealer. While players are inspecting their two new cards in combination with their four held cards, at 355, the dealer deals one face-down community card into each replacement card area 112-1 through 112-6. At 360, if a player now holds a hand forming a Hu, the player may declare the Hu or may elect not to declare the same. At 365, if any player declares a Hu (deemed a Di-Hu at this stage of the hand) the player reveals his or her cards and is paid, according to pay table 150, 2 to 1 on the player's Tian-Hu wager or, if the player placed the optional Di-Hu double down wager, 4 to 1. If the hand forming the Di-Hu also forms a flush, the player is also paid the flush Hu bonus of one-half the Tian-Hu wager, or, if the player placed the optional Di-Hu double down wager, even money on the Tian-Hu wager. After the payouts have been made, the dealer collects the cards of any declaring players and those players are out of the remainder of the hand, except that those players' bonus wagers, if any, remain in play. At 370, any remaining player may elect to remain in the hand, or may fold by discarding all of his/her cards face-down on the table. At 375, folding players are out of the hand such that they lose their Tian-Hu wager and any placed Di-Hu double down wager. Folding players who placed a bonus wager remain eligible for the bonus payout. At 380, players electing to remain in the hand do so by placing a wager in the Fa-Hu wager area 125. The Fa-Hu wager may be, as depicted in the Fa-Hu wager area 125, equal to or twice the player's Tian-Hu wager. Players electing to remain in the hand also lose any placed Di-Hu double down wagers, must discard two cards face-down and either turn their remaining four cards face-up on the table or leave their remaining four cards face-down for the dealer to open. At 385, once all players have elected to remain in the hand or folded, the dealer collects all of the discarded cards and removes them from the table and starting with the left-most card (from the dealer's vantage point), the dealer turns over four of the six community cards. At 390, it is determined if any one of the four community cards is a joker. If so, at 395, the dealer removes the joker and replaces it with a new card from the deck.

At 400, starting with the left-most player (from the dealer's vantage point), the dealer inspects each remaining player's hand to determine whether the combination of the player's four cards and the four community cards forms a Hu (deemed a Fa-Hu at this stage of the hand). A Fa-Hu must include at least one non-community card. If so, at 405, any player holding a Fa-Hu is paid, according to pay table 150, even money on his or her Tian-Hu and Fa-Hu wagers. If the five cards also form a flush, the player is paid the flush Hu bonus equal to one-half the Fa-Hu wager. After the payouts have been made, the players holding Fa-Hus are out of the hand (except that those players' bonus wagers, if any, remain in play) causing the dealer to collect their cards. At 410, any player not holding a Fa-Hu may elect to remain in the hand or fold. At 415, folding players lose their Tian-Hu and Fa-Hu wagers and the dealer collects their cards. At 420, players electing to remain in the hand for a fourth round must place a Ting-Hu wager in the Ting-Hu (10-Hu) wager area 130. The Ting-Hu wager, as depicted in the Ting-Hu wager area 130, may be in an amount equal to, double or triple the player's Tian-Hu wager. At 425, after each player has elected to either fold or remain in the hand, the dealer turns over, beginning with the left-most card (from the dealer's vantage point), the two remaining community cards. At 430, it is determined whether either of the two community cards is a joker. If so, at 435, the dealer removes the joker and replaces it with a new card from the deck.

At 440, starting with the left-most player (from the dealer's vantage point), the dealer inspects each remaining player's hand to determine whether the combination of the player's four cards and the six community cards forms a Hu (deemed a Ting-Hu at this stage of the hand). A Ting-Hu must include at least one non-community card. At 445, any player holding a Ting-Hu is paid, according to pay table 150, even money on their Tian-Hu, Fa-Hu and Ting-Hu wagers. If the five cards also form a flush, the player is paid the flush Hu bonus equal to one-half the Ting-Hu wager.

At 450, after all wagers according to pay table 150 have been resolved, any bonus wagers are resolved. The bonus wagers are resolved based on the six community cards only and are paid according to pay table 155. All players that placed a bonus wager, including those players who folded during the hand and those players who declared a Hu during the hand remain eligible for a bonus payout and, if the six community cards achieve a sufficient rank, are paid according to pay table 155. The bonus payouts are additive such that a player may be paid on more than one outcome. If all players either declared a Hu or folded prior to the six community cards being revealed, the placed bonus wagers are returned to the players. FIG. 14 shows a table 500 detailing an exemplary payout scheme for one embodiment of the present invention with a flush Hu paying one-half the last wager, or even money on the Di Hu double-down wager, if placed.

While the flowchart 300 details one embodiment of the present invention, the method of play may be varied. For example: three or two community cards may be revealed during the Fa-Hu round and the other three or four community cards, respectively, may be revealed during the Ting-Hu round; cards can be discarded face-up after the Tian-Hu round, either sequentially or simultaneously by all players; or the declaration of Tian-Hu and/or Di-Hu hands can be made mandatory rather than optional. Also, the payout structure may be altered as desired by the casinos and other gaming establishments such that the house advantage is in line with the industry standards. Moreover, the Fa-Hu and Ting-Hu betting structure (e.g., limits) may be modified.

The embodiments of the present invention may also be facilitated by electronic gaming devices or accessed online. With such systems, a processor and software control the game and its outcomes. The operation of electronic gaming devices and the Internet are well known to those skilled in the art.

Although the invention has been described in detail with reference to several embodiments, additional variations and modifications exist within the scope and spirit of the invention as described and defined in the following claims.

I claim:

1. A method of conducting a card game using one or more decks of cards depicting Mahjong-type symbols comprising:

requiring participating players to place an initial wager to participate in a current hand; providing one or more participating players with at least five initial cards;

providing payouts to any player optionally declaring a Tian-Hu formed using the at least five initial cards wherein any such player is out of the current hand;

requiring remaining players to discard at least one card and providing each player with a number of replacement cards equal to the number of discards;

providing payouts to any player optionally declaring a Di-Hu formed using the at least five cards, comprising held initial cards and the replacement cards, wherein any such player is out of the current hand;

requiring remaining players to place a second wager and to discard at least one card in order to continue in the hand or allowing players to fold thereby losing the initial wager;

revealing a first set of one or more community cards;

providing payouts to any player holding a Fa-Hu formed using the at least five cards, comprising a combination of some initial cards and the replacement cards, in combination with the first set of one or more community cards wherein any such player is out of the current hand;

requiring remaining players to place a third wager in order to continue in the hand or allowing players to fold thereby losing the initial and second wagers;

revealing a second set of one or more community cards; and providing payouts to any player holding a Ting-Hu formed using the at least five cards, comprising held initial cards and the replacement cards, in combination with the first and second set of one or more community cards wherein at least one card of a Ting-Hu hand must be a held initial card or replacement card.

2. The method of claim 1 further comprising providing a flush Hu bonus based on any Tian-Hu, Di-Hu, Fa-Hu or Ting-Hu also forming a flush.

3. The method of claim 1 further comprising utilizing the following pay table to determine payouts:

| Hand | Payout |
|---|---|
| Tian-Hu | 5 to 1 |
| Di-Hu | 2 to 1 |
| Fa-Hu (8-Hu) | 1 to 1 |
| Ting-Hu (10-Hu) | 1 to 1 |
| Flush-Hu | One-half the last wager, or even money on the Di Hu double-down wager, if placed. |

4. The method of claim 1 further comprising permitting players to place an optional double down wager in conjunction with the requirement to discard at least one card, said double down wager applicable to a player declaring a Di-Hu such that a Di-Hu payout and corresponding flush Hu bonus are doubled.

5. The method of claim 1 further comprising allowing players to place a bonus wager prior to receiving the at least five initial cards wherein the bonus wager is dependent upon a ranking of the first and second sets of community cards only.

6. The method of claim 5 wherein all bonus wagers are deemed a push if all players Hu or fold prior to the second set of community cards being exposed.

7. The method of claim 5 further comprising utilizing the following pay table to determine payouts:

| Hand | Bonus Payout |
|---|---|
| 6-Card Straight Flush | 1000× |
| 6-Card Flush | 5× |
| Hu | 15× |
| 1 Trips | 30× |
| 2 Trips | 60× |
| 3 Pairs | 60× |
| All Players Fold and/or Hu | Push. |

8. The method of claim 7 wherein the payouts are additive.

9. The method of claim 1 further comprising requiring the second wager to be equal to or double the initial wager.

10. The method of claim 1 further comprising requiring the third wager to be equal to, double or triple the initial wager.

11. The method of claim 1 further comprising providing six initial cards.

12. The method of claim 1 wherein the first set of community cards comprises four cards and the second set of community cards comprises two cards.

13. The method of claim 1 further comprising utilizing a single deck of 82 cards comprising three unique suits wherein each suit includes three sets of identical cards formed of cards having a numerical rank of 1 through 9, and a joker.

14. The method of claim 13 wherein the suits comprise copper, bamboo and kanji; tong, tiao and wan; or coin, rope and wan.

15. A method of conducting a card game using one or more decks of cards depicting Mahjong-type symbols comprising:

requiring participating players to place a Tian-Hu wager to participate in a current hand;

providing participating players with an option to place a bonus wager;

providing one or more participating players with six initial cards;

providing payouts to any player optionally declaring a Tian-Hu formed using five of the six initial cards;

requiring remaining players to discard two cards and providing each player with two replacement cards;

providing payouts to any player optionally declaring a Di-Hu formed using five of six cards comprising four initial cards and the two replacement cards;

requiring remaining players to place a Fa-Hu wager and to discard two cards in order to continue in the hand or allowing players to fold thereby losing the Tian-Hu wager;

revealing a first set of four community cards;

providing payouts to any player holding a Fa-Hu formed using the four cards in a player's hand in combination with the four community cards;

requiring remaining players to place a Ting-Hu wager in order to continue in the hand or allowing players to fold thereby losing the Tian-Hu and Fa-Hu wagers;

revealing a second set of two community cards;

providing payouts to any player holding a Ting-Hu formed using the four cards in combination with the six community cards wherein a Ting-Hu must include at least on non-community card; and resolving any eligible placed bonus wagers based on a rank of the six community cards only.

16. The method of claim 15 further comprising providing a flush Hu bonus based on any Tian-Hu, Di-Hu, Fa-Hu or Ting-Hu also forming a flush.

17. The method claim 15 further comprising utilizing the following pay table to determine payouts:

| Hand | Payout |
|---|---|
| Tian-Hu | 5 to 1 |
| Di-Hu | 2 to 1 |
| Fa-Hu (8-Hu) | 1 to 1 |
| Ting-Hu (10-Hu) | 1 to 1 |
| Flush-Hu | One-half the last wager, or even money on the Di Hu double-down wager, if placed. |

18. The method of claim 15 further comprising providing an optional double down wager dependent upon a player declaring a hand comprising a Di-Hu such that a Di-Hu payout and corresponding Flush-Hu bonus are doubled.

19. The method of claim 15 wherein players folding or declaring a Hu remain eligible for the bonus payout.

20. The method of claim 15 further comprising utilizing the following pay table to determine payouts:

| Hand | Bonus Payout |
|---|---|
| 6-Card Straight Flush | 1000× |
| 6-Card Flush | 5× |
| Hu | 15× |
| 1 Trips | 30× |
| 2 Trips | 60× |
| 3 Pairs | 60× |
| All Players Fold and/or Hu | Push. |

21. The method of claim 20 wherein the bonus payouts are additive.

22. The method of claim 15 further comprising requiring the Fa-Hu wager to be equal to or double the Tian-Hu wager.

23. The method of claim 15 further comprising requiring the Ting-Hu wager to be equal to, double or triple the Tian-Hu wager.

24. The method of claim 15 further comprising utilizing a single deck of 82 cards comprising three unique suits wherein each suit includes three sets of identical cards formed of cards ranked from 1 through 9, and a joker.

25. The method of claim 24 wherein the suits comprise copper, bamboo and kanji; tong, tiao and wan; or coin, rope and wan.

* * * * *